US006896200B2

(12) United States Patent
Dobson

(10) Patent No.: US 6,896,200 B2
(45) Date of Patent: May 24, 2005

(54) HAND-HELD APPLICATOR DEVICE FOR APPLYING A LAYER OF FLUID DROPLETS

(76) Inventor: David O. Dobson, 408 Whispering Pines, Normal, IL (US) 61761

( * ) Notice: Subject to any disclaimer, the term of this patent is extended or adjusted under 35 U.S.C. 154(b) by 460 days.

(21) Appl. No.: 10/035,849

(22) Filed: Dec. 31, 2001

(65) Prior Publication Data

US 2003/0121990 A1 Jul. 3, 2003

(51) Int. Cl.[7] ..... B05B 3/02

(52) U.S. Cl. ..... 239/222.11; 239/214; 239/215; 239/220; 239/221; 239/225.1; 239/223; 239/224

(58) Field of Search ..... 239/214, 215, 239/218, 219, 220, 221, 222, 222.11, 225.1, 228, 231, 121, 152, 223, 224

(56) References Cited

U.S. PATENT DOCUMENTS

| | | | | | |
|---|---|---|---|---|---|
| 629,513 | A | | 7/1899 | Liebscher | |
| 2,583,767 | A | * | 1/1952 | Michel | 239/220 |
| 2,763,510 | A | * | 9/1956 | Di Nicola | 239/220 |
| 2,986,337 | A | * | 5/1961 | Claire Clare | 239/220 |
| 3,047,237 | A | * | 7/1962 | Tambolleo | 239/215 |
| 4,040,385 | A | * | 8/1977 | Tost | 118/326 |
| 5,314,119 | A | | 5/1994 | Watt | |
| 5,842,642 | A | * | 12/1998 | Plasko | 239/220 |

* cited by examiner

*Primary Examiner*—Robin O. Evans
(74) *Attorney, Agent, or Firm*—Enrique J. Mora, Esq.; Beusse, Brownlee, Wolter, Mora & Maire, P.A.

(57) ABSTRACT

A hand-held device for applying a layer of fluid droplets on a target or subject is provided. The device includes a housing with a fluid reservoir. The device further includes an inlet port in the housing for receiving pressurized fluid. A rotatable brush roll in the housing includes a plurality of bristles. The brush roll is configured for rotation along an axis positioned to have a selected spatial relationship relative to an exit window in the housing. A conduit for delivering the pressurized fluid to the bristles in the brush roll is provided. At least one flipper element is positioned to contact the tips of the bristles extending over a corresponding section of the rotatable roll so that fluid collected therein is propelled through the exit window in the housing with a pattern at least in part based on the selected spatial relationship between the rotation axis of the brush roll and the exit window. An outlet port is provided for draining fluid that accumulates in the reservoir.

19 Claims, 5 Drawing Sheets

HAND-HELD APPLICATOR DEVICE FOR APPLYING A LAYER OF FLUID DROPLETS

BACKGROUND OF THE INVENTION

It is well-known in the art to apply thin coatings or layers of fluid material by various techniques, such as spraying using pneumatic sprays, roller-coating, brush-coating, and the like. Such devices can apply thin coatings of fluids, either in the liquid form, such as adhesives, paint, insecticides, fertilizer, or in the solid or semi-solid state, such as pellets, beads and the like.

The present invention relates to a kind of applicator that utilizes a plurality of bristles in a brush-like configuration that is rotated to flick small droplets of the fluid to be applied on an object or subject receiving the droplets. Such devices may be in a bristle-brush form in roll or cylindrical configuration, or bristle-brush form in an upstanding array which, when agitated, flicks the pellets, droplets, beads or mist from the edge of the bristles onto the target or subject to be coated.

Devices of this general nature have been disclosed, for example, in U.S. Pat. No. 5,314,119, dated May 24, 1994 and titled "Method and Apparatus For Thin Coatings of Fluid Droplets". The device disclosed in that patent appears to emphasize use of a windage control mechanism to purportedly prevent unwanted variations in the coating operation. However, no known devices are believed to address various shortcomings present in such devices, such as lack of portability and flexibility in the configuration of the pattern of fluid projected by such devices. The inventor of the present invention has innovatively recognized improved techniques that allow to overcome such shortcomings by providing a light-weight and compact, hand-held applicator that may be configured to project a pattern or "foot print" of the fluid best suited to any desired application. It would be further desirable to provide an applicator device that uses relatively few components based on proven and commercially available technologies that would allow for such improved device to be manufactured and assembled at low cost to provide durable and satisfactory operation to consumers.

BRIEF SUMMARY OF THE INVENTION

Generally, the present invention fulfills the foregoing needs by providing in one aspect thereof a hand-held device for applying a layer of fluid droplets. The device includes a housing with a fluid reservoir. The device further includes an inlet port in the housing for receiving pressurized fluid. A rotatable brush roll in the housing includes a plurality of bristles. The brush roll is configured for rotation along an axis positioned to have a selected spatial relationship relative to an exit window in the housing. A conduit for delivering the pressurized fluid to the bristles in the brush roll is provided. At least one flipper element is positioned to contact the tips of the bristles extending over a corresponding section of the rotatable roll so that fluid collected therein is propelled through the exit window in the housing with a pattern at least in part based on the selected spatial relationship between the rotation axis of the brush roll and the exit window. An outlet port is provided for draining fluid that accumulates in the reservoir.

The present invention further fulfills the foregoing needs by providing in another aspect thereof, a hand-held device for applying a layer of fluid droplets. The device comprises a housing including a fluid reservoir. A rotable brush roll in the housing includes a plurality of bristles. The brush roll is configured for rotation along an axis positioned to have a selected spatial relationship relative to an exit window in the housing, wherein the exit window extends at least along a longitudinal axis and the rotation axis of the brush roll is positioned generally perpendicular relative to the longitudinal axis of the exit window. A conduit for delivering pressurized fluid to the bristles in the brush roll is provided. At least one flipper element is positioned to contact the tips of the bristles extending over a corresponding section of the rotatable brush roll so that fluid collected therein is propelled through the exit window in the housing with a pattern angularly spreadable along the longitudinal axis and focused along the width of the window.

In yet another aspect thereof, the present invention provides a hand-held device for applying a layer of fluid droplets. The device comprises a housing including a fluid reservoir. A rotable brush roll in the housing includes a plurality of bristles. The brush roll is configured for rotation along an axis positioned to have a selected spatial relationship relative to an exit window in the housing, wherein the exit window extends at least along a longitudinal axis and the rotation axis of the brush roll is positioned generally parallel relative to the longitudinal axis of the exit window. A conduit for delivering pressurized fluid to the bristles in the brush roll is provided. At least one flipper element is positioned to contact the tips of the bristles extending over a corresponding section of the rotatable brush roll so that fluid collected therein is propelled through the exit window in the housing with a pattern angularly spreadable along the width of the window and focused along the longitudinal axis.

BRIEF DESCRIPTION OF THE DRAWINGS

The features and advantages of the present invention will become apparent from the following detailed description of the invention when read with the accompanying drawings in which.

DETAILED DESCRIPTION OF THE INVENTION

Figure 1:
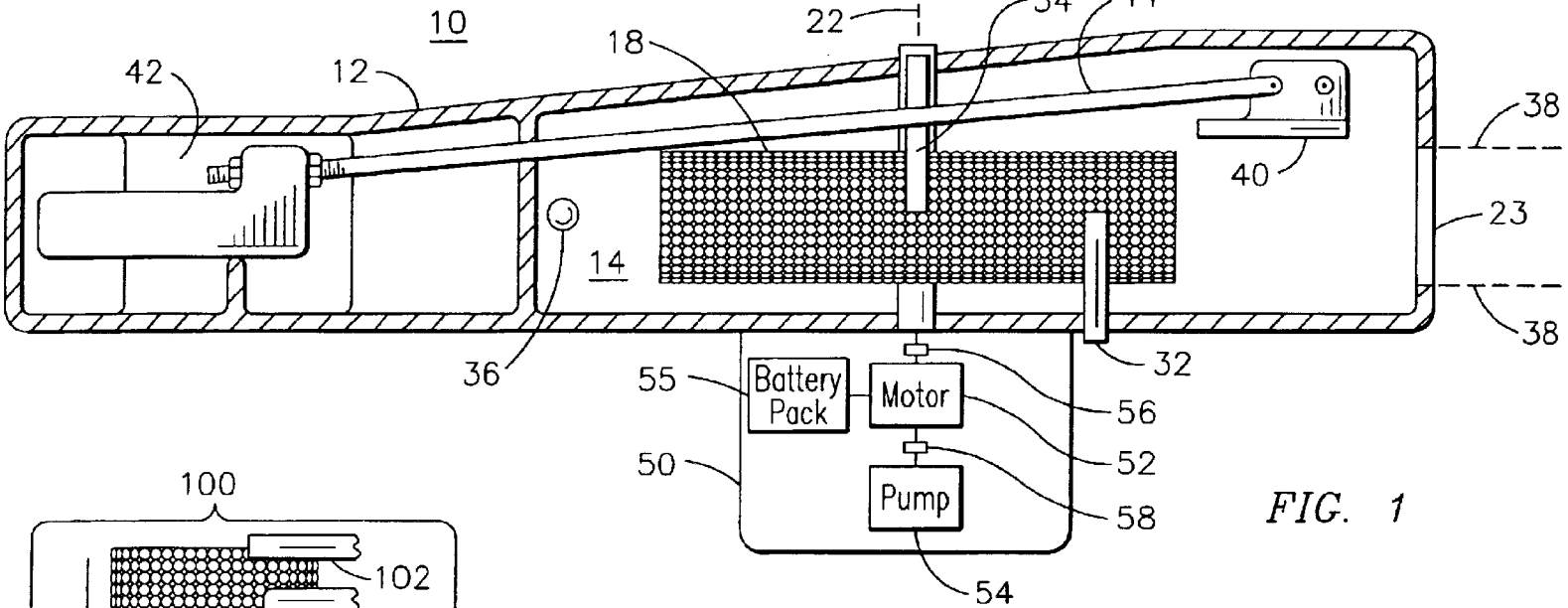
FIG. 1 illustrates a top view of one exemplary embodiment of an applicator device using a rotatable brush roll supported along a rotation axis perpendicular relative to the longitudinal axis of an exit window in accordance with aspects of the present invention.

FIG. 1 illustrates a top view of one exemplary embodiment of a hand-held applicator device 10 for applying a layer of fluid or coating of droplets in accordance with aspects of the present invention. It is contemplated that the applicator of the present invention may be used in a wide range of fluid delivery applications, such as delivery of adhesives, paint, insecticides, fertilizer, etc. As shown in FIG. 1, device 10 includes a housing 12, such as may be made of molded plastic or any other relatively light and corrosive-resistant material. Housing 12 includes a fluid reservoir 14 and an inlet port 16, shown in FIGS. 3 and 6, for receiving pressurized fluid, such as may be pressurized at a relatively low pressure, e.g., 2–3 psi. It will be appreciated that the foregoing range is merely exemplary since such range may vary based on the physical properties (e.g., viscosity) of the specific fluid being applied. The interior of housing 12 supports a rotable brush roll 18 having a plurality of bristles 20, better appreciated in FIGS. 2 and 4. The bristles may be made of nylon or other generally resilient synthetic materials, or animal-derived whiskers. Rotatable roll 18 is configured for rotation along a rotation axis 22 positioned to have a selected spatial relationship relative to an exit window 23 in the housing. In the exemplary embodiments seen in FIGS. 3 and 6, the exit window comprises a generally rectangular window having a predefined width and height that extends along a longitudinal axis 24. As will be appreciated by those skilled in the art, the present invention is not limited to any particular configuration for the exit window since other window configurations could be used.

Figure 2:
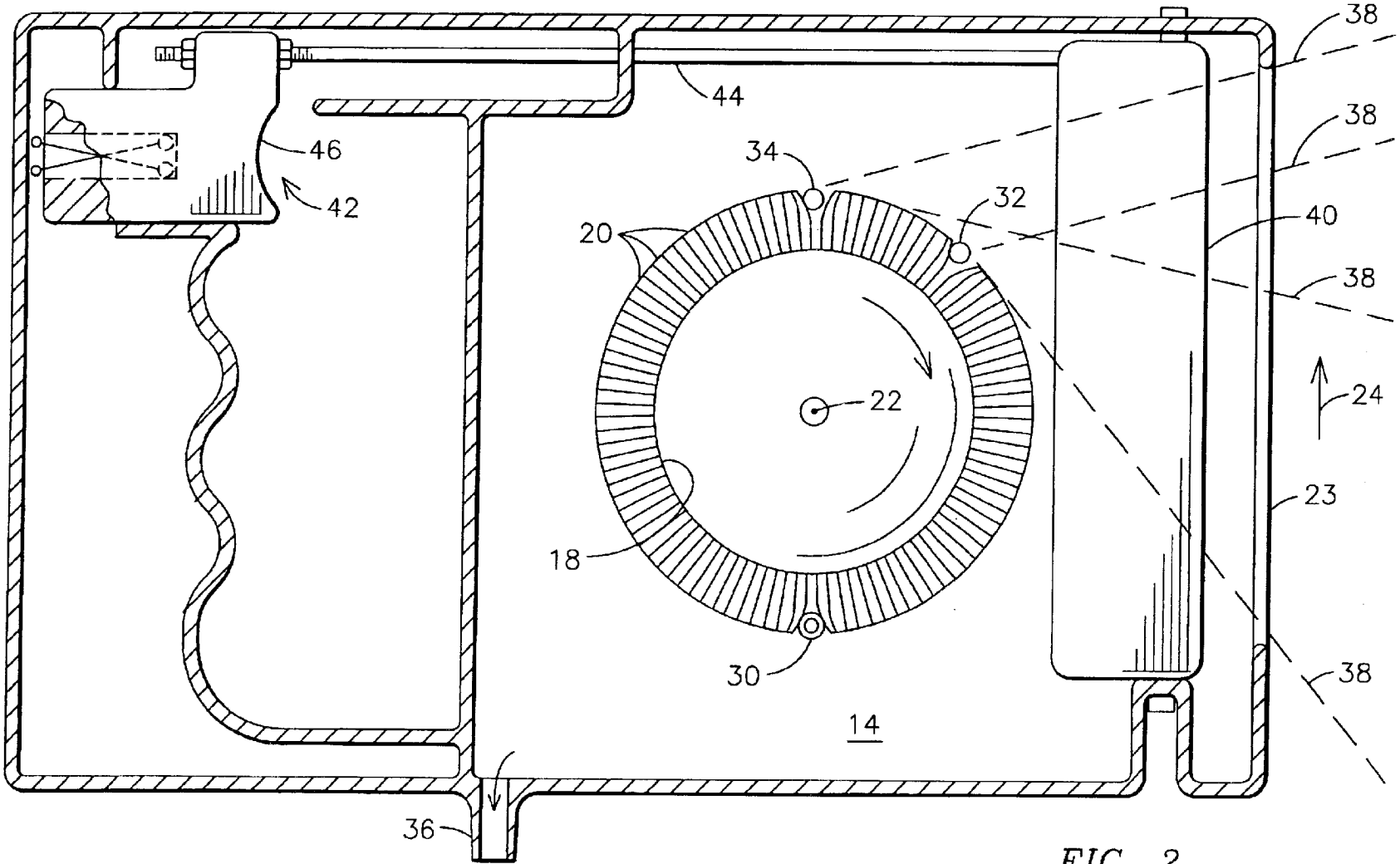
FIG. 2 illustrates a side view of the applicator device of FIG. 1.
Figure 3:
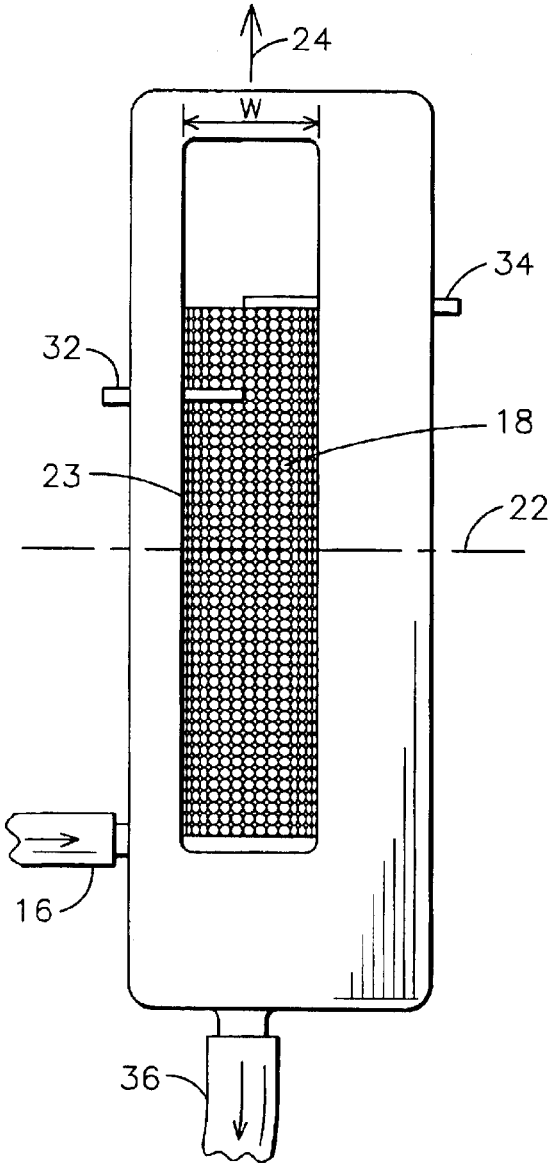
FIG. 3 illustrates a front view of the applicator device of FIG. 1.
Figure 4:
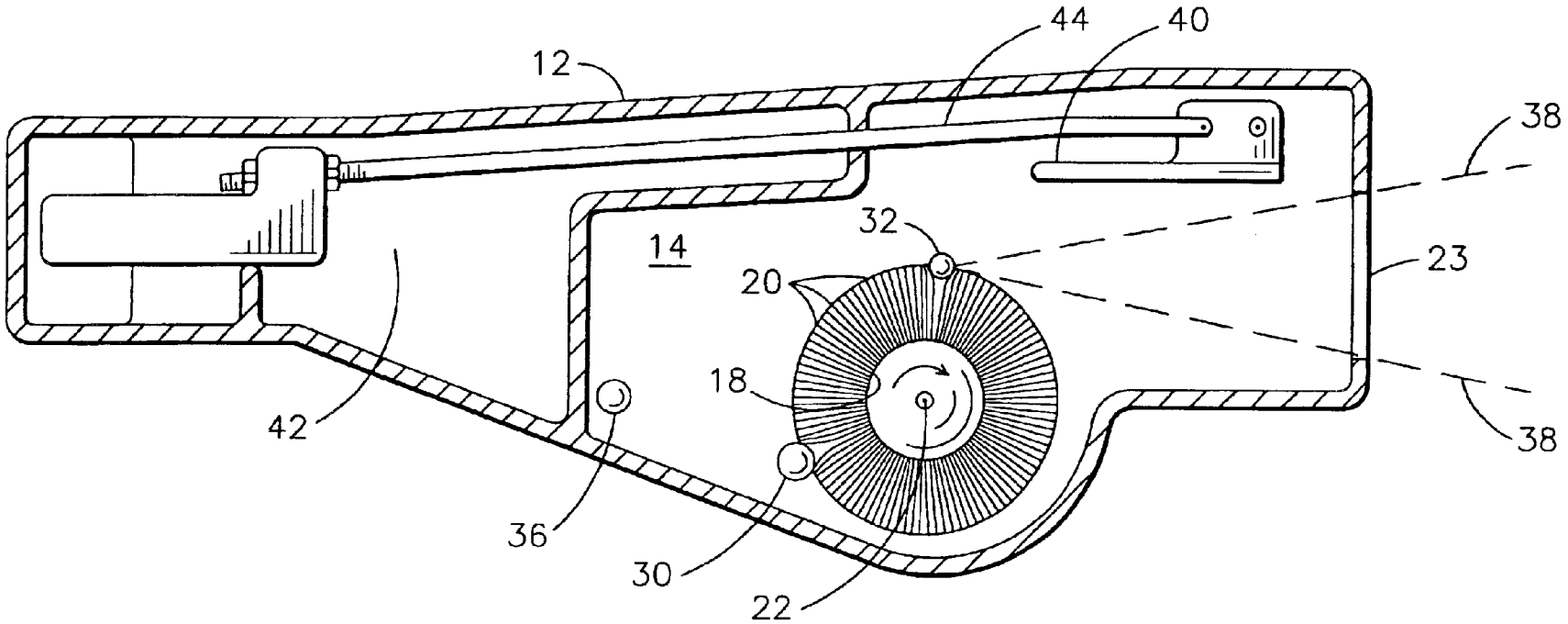
FIG. 4 illustrates a top view of another exemplary embodiment of the applicator device wherein the rotatable roll is supported along a rotation axis parallel relative to the longitudinal axis of the exit window of the device.

FIG. 2 illustrates a conduit 30 for delivering the pressurized fluid to the bristles in the brush roll and further illustrates at least one flipper element, e.g., flippers 32 and 34 in FIG. 2, and single flipper 32 in FIG. 4, positioned to contact the tips of the bristles extending over a corresponding section of the rotatable roll so that fluid collected on the bristles is propelled through the exit window in the housing with a pattern or foot print, at least in part, based on the selected spatial relationship between the rotation axis of the brush roll and the exit window. For example, in the embodiment illustrated in FIGS. 1–3, the rotation axis 22 of the brush roll is positioned generally perpendicular relative to the longitudinal axis 24 of the exit window and this arrangement results in a pattern angularly spreadable along longitudinal axis 24 and focused along the width of the window, as represented by dashed lines 38 in FIGS. 1 and 2. That is, the width of the pattern of the projected fluid essentially corresponds to the width of the window, assuming the axial dimension of the rotatable roll substantially encompasses the width of the exit window. As suggested above, the fluid droplets would be angularly spreadable along the longitudinal axis as such droplets are radially projected away from the surface of the rotable roll as each bristle is initially deflected backwards and then forward as each bristle rotates past each interfering flipper.

Figure 6:
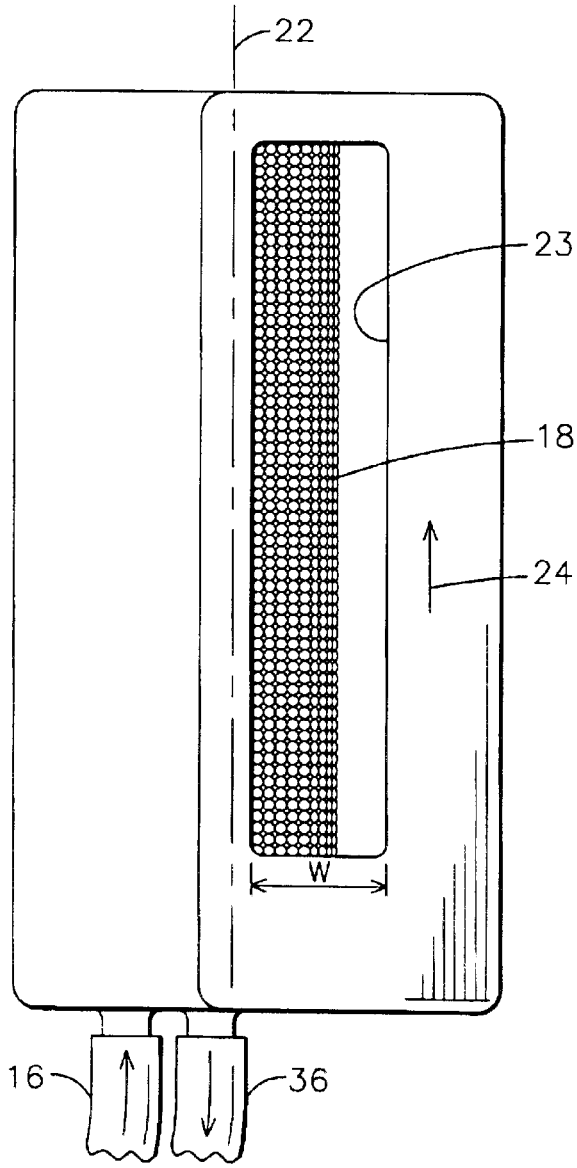
FIG. 6 illustrates a front view of the applicator device show in FIG. 4.
Figure 5:
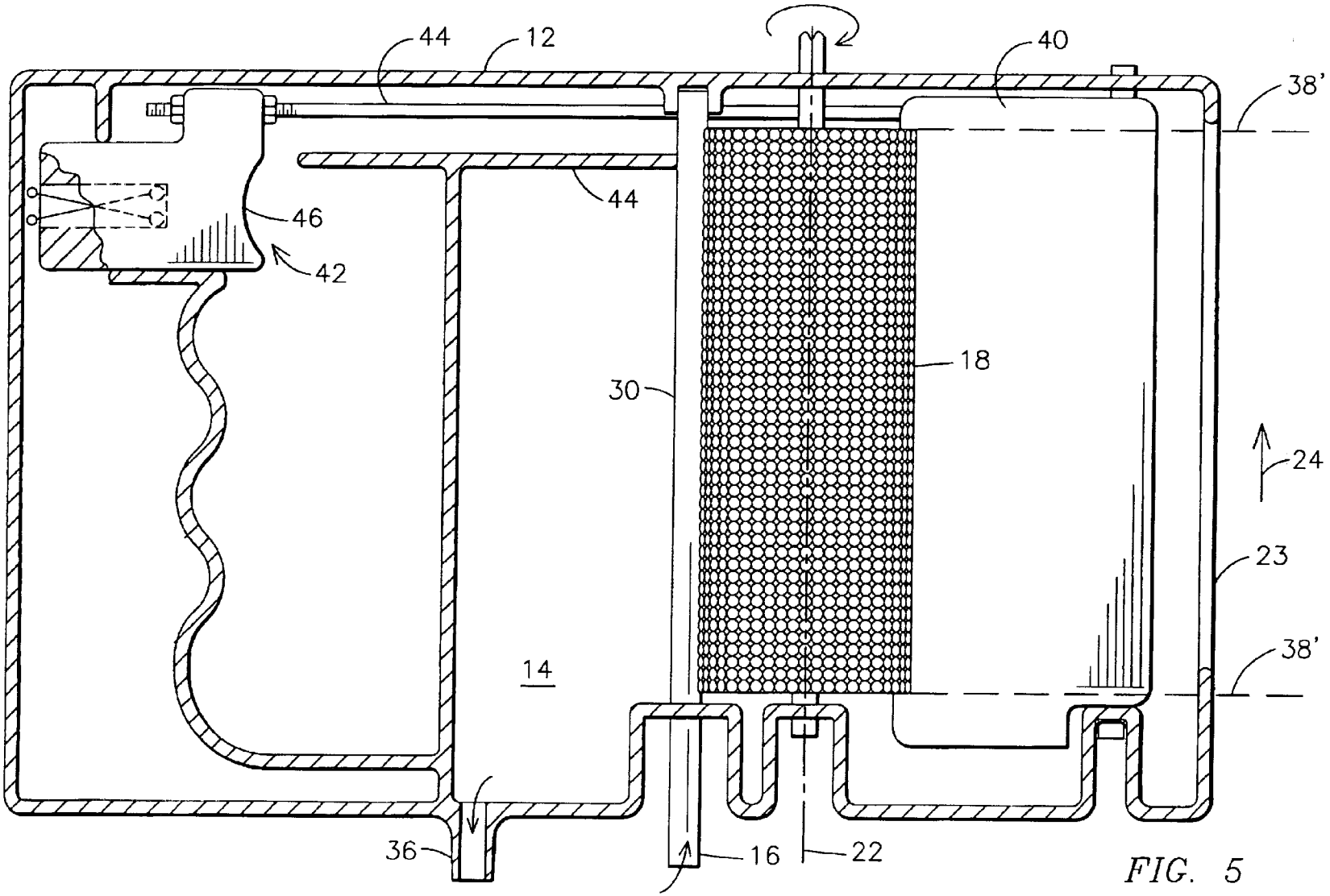
FIG. 5 illustrates a side view of the applicator device shown in FIG. 4.

In the embodiment illustrated in FIGS. 4–6, the rotation axis 22 of the brush roll is positioned generally parallel relative to the longitudinal axis 24 of the exit window and this arrangement results in a pattern focused along that longitudinal axis 24 and spreadable along the width of the window, as represented by dashed lines 38' in FIGS. 4 and 5. That is, the height of the pattern of the projected fluid essentially corresponds to the height of the window, assuming the axial dimension of the rotatable roll substantially encompasses the height of the window. In this case, the fluid droplets would be angularly spreadable relative to the width of the window as such droplets are radially projected away from the surface of the rotable roll since in this case the axis of rotation of roll 18 is perpendicular relative to the width of the exit window.

As can be seen at least in FIGS. 3 and 6, an outlet port 36 is provided in the housing for draining fluid that accumulates in the reservoir. That is, reservoir 14 allows collecting fluid that is not projected through the exit window due to the flickering action between the bristles of the rotating roll and the flipper. In one exemplary embodiment, the draining action provided through outlet port 36 is gravity-driven. That is, the fluid is drained due to gravitational force.

FIG. 1 further includes a shutter 40 coupled to a trigger assembly 42 through a control rod 44 for selectively opening and closing the exit window in response to respective commands from an operator of the device. For example, the operator may depress a spring-biased trigger 46 that linearly extends control rod 44 to cause shutter 40 to be pivoted to an open condition. Conversely, once the operator releases trigger 46 control rod 44 may retract and cause shutter 40 to be pivoted to the closed condition. It will be appreciated by those skilled in the art that various alternative implementations could be used for implementing the trigger assembly. For example, in lieu of a mechanically actuated trigger assembly, one could use a solenoid for actuating the shutter into the desired open or closed condition.

As further shown in FIG. 1, an enclosure 50 connectable to housing 12 is provided for receiving an electric motor 52 coupled to drive the rotatable roll. Enclosure 50 may also include a pump 54 powered by the motor and in fluid communication with the conduit 30 (FIG. 2) to supply the pressurized fluid to the bristles in the rotatable roll. The pump would also be in fluid communication with an external source of the fluid, e.g., a bucket of paint, etc. In one exemplary embodiment, the electric motor comprises a direct current (dc) motor, e.g., a brushless dc motor, powered by a self-contained power source. For example, the power source could be a battery pack 55 that may be optionally rechargeable. Blocks 56 and 58 represent gear boxes that could be optionally used for achieving a desired gear ratio between the motor and the respective components driven by the motor. That is, the pump and the shaft that supports the rotatable roll. It will be appreciated that each of the foregoing electromechanical components may be comprised of relatively inexpensive off-the-shelf components.

Although in FIGS. 2 and 4 the conduit 30 that supplies pressurized fluid to the bristles is shown as a separate component relative to flippers 32 or 34, it is contemplated that the conduit for delivering the pressurized fluid to the rotatable brush roll could be integrated within at least one of the flipper elements. That is, any or both of flippers 32 and 34 could be made hollow to provide a conduit to supply the pressurized fluid to the bristles on the rotatable brush.

Figure 7:
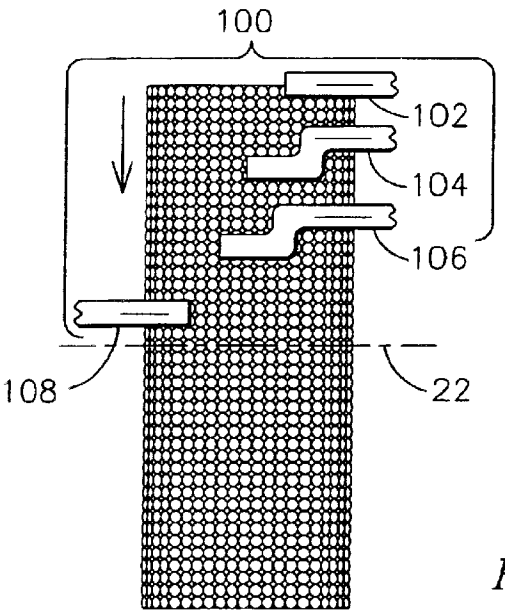
FIG. 7 illustrates an exemplary embodiment of a flipper array for flickering or projecting the droplets of fluid that accumulate on the bristles of the rotatable roll on the FIG. 1 device.

FIG. 7 illustrates an embodiment of a flipper array 100 made up of a plurality of flipper elements, such as flipper elements 102, 104, 106, 108 each distributed over respective sections of the brush roll so that each flipper element contributes a portion to the overall pattern of fluid propelled through the exit window. The flipper array 100 may be configured so that at least one or more of the flipper elements therein is adjustable to vary the pattern of fluid propelled through the exit window. The adjustment could be made by way of screws, springs or any other suitable structure that would allow for selectably translating each flipper element parallel to rotation axis 22. It will be appreciated that one of the advantages of this embodiment is that a flipper array allows varying the pattern of fluid propelled through the exit window. Moreover, by way of comparison a flipper array as shown in FIG. 6 would impose a smaller load on the motor, as compared to multiple flippers wherein each flipper extends along the full width of the rotating roll.

While the preferred embodiments of the present invention have been shown and described herein, it will be obvious that such embodiments are provided by way of example only. Numerous variations, changes and substitutions will occur to those of skill in the art without departing from the invention herein. Accordingly, it is intended that the invention be limited only by the spirit and scope of the appended claims.

What is claimed is:

1. A hand-held device for applying a layer of fluid droplets, said device comprising:

a housing including a fluid reservoir;

an inlet port in the housing for receiving pressurized fluid;

a rotatable brush roll including a plurality of bristles, the brush roll being configured for rotation along an axis positioned to have a selected spatial relationship relative to an exit window in the housing;

a conduit for delivering the pressurized fluid to the bristles in the brush roll;

at least one flipper element positioned to contact the tips of the bristles extending over a corresponding section of the rotatable roll so that fluid collected therein is propelled through the exit window in the housing with a pattern at least in part based on the selected spatial relationship between the rotation axis of the brush roll and the exit window;

an outlet port for draining fluid that accumulates in the reservoir; and a shutter coupled to a trigger assembly for selectively opening and closing the exit window in response to respective commands from an operator of the device.

2. A hand-held device for applying a layer of fluid droplets, said device comprising:

a housing including a fluid reservoir;

an inlet port in the housing for receiving pressurized fluid;

a rotatable brush roll including a plurality of bristles, the brush roll being configured for rotation along an axis positioned to have a selected spatial relationship relative to an exit window in the housing;

a conduit for delivering the pressurized fluid to the bristles in the brush roll;

at least one flipper element positioned to contact the tips of the bristles extending over a corresponding section of the rotatable roll so that fluid collected therein is propelled through the exit window in the housing with a pattern at least in part based on the selected spatial relationship between the rotation axis of the brush roll and the exit window;

an outlet port for draining fluid that accumulates in the reservoir; and an enclosure for receiving an electric motor coupled to drive the rotatable roll.

3. The hand-held device of claim 2 wherein the exit window comprises a generally rectangular window and the rotation axis of the brush roll is positioned generally parallel relative to the longitudinal axis of the exit window.

4. The hand-held device of claim 2 wherein the exit window comprises a generally rectangular window and the rotation axis of the brush roll is positioned generally perpendicular relative to the longitudinal axis of the exit window.

5. The hand-held device of claim 2 wherein the at least one flipper element is part of a flipper array including additional flipper elements each distributed over respective sections of the brush roll so that each flipper element contributes a portion to the overall pattern of fluid propelled through the exit window.

6. The hand-held device of claim 2 further including a pump powered by the motor and in fluid communication with the conduit to supply the pressurized fluid to the bristles in the rotatable roll.

7. The hand-held device of claim 2 further including a rechargeable power source coupled to the electric motor.

8. The hand-held device of claim 5 wherein at least one or more of the flipper elements in the flipper array is adjustable to vary the pattern of fluid propelled through the exit window.

9. A hand-held device for applying a layer of fluid droplets, said device comprising:

a housing including a fluid reservoir;

an inlet port in the housing for receiving pressurized fluid;

a rotatable brush roll including a plurality of bristles, the brush roll being configured for rotation along an axis positioned to have a selected spatial relationship relative to an exit window in the housing;

a conduit for delivering the pressurized fluid to the bristles in the brush roll;

at least one flipper element positioned to contact the tips of the bristles extending over a corresponding section of the rotatable roll so that fluid collected therein is propelled through the exit window in the housing with a pattern at least in part based on the selected spatial relationship between the rotation axis of the brush roll and the exit window, wherein the conduit for delivering the pressurized fluid to the rotatable brush roll is integrated with the at least one flipper elements; and an outlet port for draining fluid that accumulates in the reservoir.

10. A hand-held device for applying a layer of fluid droplets, said device comprising:

a housing including a fluid reservoir;

a rotatable brush roll in the housing and including a plurality of bristles, the brush roll configured for rotation along an axis positioned to have a selected spatial relationship relative to an exit window in the housing, wherein the exit window extends at least along a longitudinal axis and the rotation axis of the brush roll is positioned generally perpendicular relative to the longitudinal axis of the exit window;

a conduit for delivering pressurized fluid to the bristles in the brush roll;

at least one flipper element positioned to contact the tips of the bristles extending over a corresponding section of the rotatable brush roll so that fluid collected therein is propelled through the exit window in the housing with a pattern angularly spreadable along said longitudinal axis and focused along the width of the window; and a shutter coupled to a trigger assembly for selectively opening and closing the exit window in response to respective commands from an operator of the device.

11. A hand-held device for applying a layer of fluid droplets, said device comprising:

a housing including a fluid reservoir;

a rotatable brush roll in the housing and including a plurality of bristles, the brush roll configured for rotation along an axis positioned to have a selected spatial relationship relative to an exit window in the housing, wherein the exit window extends at least along a longitudinal axis and the rotation axis of the brush roll is positioned generally perpendicular relative to the longitudinal axis of the exit window;

a conduit for delivering pressurized fluid to the bristles in the brush roll; and at least one flipper element positioned to contact the tips of the bristles extending over a corresponding section of the rotatable brush roll so that fluid collected therein is propelled through the exit window in the housing with a pattern angularly spreadable along said longitudinal axis and focused along the width of the window, wherein the conduit for delivering the pressurized fluid to the bristles in the rotatable brush roll and the at least one flipper element comprise an integral unit.

12. A hand-held device for applying a layer of fluid droplets, said device comprising:

a housing including a fluid reservoir;

a rotatable brush roll in the housing and including a plurality of bristles, the brush roll configured for rotation along an axis positioned to have a selected spatial relationship relative to an exit window in the housing, wherein the exit window longitudinally extends at least along a longitudinal axis and the rotation axis of the brush roll is positioned generally parallel relative to the longitudinal axis of the exit window;

a conduit for delivering pressurized fluid to the bristles in the brush roll;

at least one flipper element positioned to contact the tips of the bristles extending over a corresponding section of the rotatable brush roll so that fluid collected therein is propelled through the exit window in the housing with a pattern focused along said longitudinal axis and angularly spreadable relative to the width of the window; and a shutter coupled to a trigger assembly for selectively opening and closing the exit window in response to respective commands from an operator of the device.

13. A hand-held device for applying a layer of fluid droplets, said device comprising:

a housing including a fluid reservoir;

a rotatable brush roll in the housing and including a plurality of bristles, the brush roll configured for rotation along an axis positioned to have a selected spatial relationship relative to an exit window in the housing, wherein the exit window extends at least along a longitudinal axis and the rotation axis of the brush roll is positioned generally perpendicular relative to the longitudinal axis of the exit window;

a conduit for delivering pressurized fluid to the bristles in the brush roll;

at least one flipper element positioned to contact the tips of the bristles extending over a corresponding section of the rotatable brush roll so that fluid collected therein is propelled through the exit window in the housing with a pattern angularly spreadable along said longitudinal axis and focused along the width of the window; and at least one enclosure for receiving an electric motor coupled to drive the rotatable brush roll, the enclosure further receiving a pump driven by the motor and in fluid communication with the conduit to supply the pressurized fluid to the bristles in the rotatable roll.

14. The hand-held device of claim 13 wherein the at least one flipper element is part of an array including additional flipper elements each distributed over respective sections of the brush roll so that each flipper element contributes a portion to the overall pattern of fluid propelled through the exit window.

15. The hand-held device of claim 14 wherein the at least one or more of the flipper elements in the flipper array is adjustable to vary the pattern of fluid propelled through the exit window.

16. A hand-held device for applying a layer of fluid droplets, said device comprising:

a housing including a fluid reservoir;

a rotatable brush roll in the housing and including a plurality of bristles, the brush roll configured for rotation along an axis positioned to have a selected spatial relationship relative to an exit window in the housing, wherein the exit window longitudinally extends at least along a longitudinal axis and the rotation axis of the brush roll is positioned generally parallel relative to the longitudinal axis of the exit window;

a conduit for delivering pressurized fluid to the bristles in the brush roll;

at least one flipper element positioned to contact the tips of the bristles extending over a corresponding section of the rotatable brush roll so that fluid collected therein is propelled through the exit window in the housing with a pattern focused along said longitudinal axis and angularly spreadable relative to the width of the window; and at least one enclosure for receiving an electric motor coupled to drive the rotatable brush roll, the enclosure further receiving a pump driven by the motor and in fluid communication with the conduit to supply the pressurized fluid to the bristles in the rotatable roll.

17. The hand-held device of claim 16 wherein the at least one flipper element is part of an array including additional flipper elements each distributed over respective sections of the brush roll so that each flipper element contributes a portion to the overall pattern of fluid propelled through the exit window.

18. The hand-held device of claim 17 wherein at least one or more of the flipper elements in the flipper array is adjustable to vary the pattern of fluid propelled through the exit window.

19. A hand-held device for applying a layer of fluid droplets, said device comprising:

a housing including a fluid reservoir;

a rotatable brush roll in the housing and including a plurality of bristles, the brush roll configured for rotation along an axis positioned to have a selected spatial relationship relative to an exit window in the housing, wherein the exit window longitudinally extends at least along a longitudinal axis and the rotation axis of the brush roll is positioned generally parallel relative to the longitudinal axis of the exit window;

a conduit for delivering pressurized fluid to the bristles in the brush roll; and at least one flipper element positioned to contact the tips of the bristles extending over a corresponding section of the rotatable brush roll so that fluid collected therein is propelled through the exit window in the housing with a pattern focused along said longitudinal axis and angularly spreadable relative to the width of the window, wherein the conduit for delivering the pressurized fluid to the bristles in rotatable brush roll and the at least one flipper element comprise an integral unit.

* * * * *